US008622049B1

(12) United States Patent
Frankenberg

(10) Patent No.: US 8,622,049 B1
(45) Date of Patent: Jan. 7, 2014

(54) PITCHING MACHINE

(76) Inventor: Glenn Frankenberg, Purcell, OK (US)

( * ) Notice: Subject to any disclaimer, the term of this patent is extended or adjusted under 35 U.S.C. 154(b) by 181 days.

(21) Appl. No.: 12/930,372

(22) Filed: Jan. 5, 2011

Related U.S. Application Data

(63) Continuation-in-part of application No. 12/802,977, filed on Jun. 17, 2010, now abandoned, which is a continuation of application No. 12/592,453, filed on Nov. 23, 2009, now abandoned.

(60) Provisional application No. 61/200,578, filed on Dec. 1, 2008.

(51) Int. Cl.
*A63B 65/12* (2006.01)

(52) U.S. Cl.
USPC ..... 124/6

(58) Field of Classification Search
USPC ..... 124/6
See application file for complete search history.

(56) References Cited

U.S. PATENT DOCUMENTS 5,125,653 A * 6/1992 Kovacs et al. ..... 124/78
6,082,350 A * 7/2000 Crews et al. ..... 124/78

* cited by examiner

*Primary Examiner* — Alvin Hunter
*Assistant Examiner* — Amir Klayman
(74) *Attorney, Agent, or Firm* — Martin G. Ozinga; Phillips Murrah PC

(57) ABSTRACT

The present invention is a swing arm pitching machine for throwing a ball in a trajectory comprising a horizontal adjustment system for selectively varying the trajectory of a ball horizontally, a height adjustment system for selectively varying the trajectory of the ball vertically, a speed adjustment system for selectively varying the speed of the ball, and a control panel in communication with the horizontal adjustment system, the height adjustment system, and the speed adjustment system for automatically adjusting the trajectory as desired.

1 Claim, 7 Drawing Sheets

PITCHING MACHINE

CROSS-REFERENCE TO RELATED APPLICATIONS

The present application is a continuation-in-part of U.S. patent application Ser. No. 12/802,977 filed Jun. 17, 2010, currently pending, which is a continuation of U.S. Ser. No. 12/592,453, filed Nov. 23, 2009, now abandoned, which claims priority to U.S. Ser. No. 61/200,578 filed on Dec. 1, 2008. Each of the applications listed above is expressly incorporated herein by reference in their entirety.

BACKGROUND OF THE INVENTION

1. Field of the Invention

In general, the present invention relates to a ball pitching machine. More particularly, the invention provides a new pitching machine or converter to existing machines that allows pitching a ball at different user-selectable trajectories, speed, and or sequences.

2. Description of the Prior Art

Various forms of ball pitching machines are known in the prior art which are said to simulate the speed and trajectory of balls as if pitched by an actual person. These machines are frequently designed to employ a spring actuated arm mechanism, employ at least one rotating wheel or a pair of rotating co-acting wheels, rely on pneumatic pressure, or employ converging and diverging rotatable discs, to propel the ball.

In order to more accurately simulate the action of a pitched ball, it is often more desirable to utilize a machine having a pitching arm. A pitching machine with an "arm" movement is generally more realistic for purposes of batting practice because it is a better simulation as to the actual throwing by a real pitcher, therefore giving the batter a more realistic practice session. Although, there is an obvious difference between a real human arm movement and a pitching machine arm, the pitching machine arm does allow for a more realistic timing by the batter due to ability to appropriately judge the timing of the pitch by watching the arm and ball giving some notice before the ball launch, like a human pitcher in a wind-up, as opposed to wheel machines that give no visual notice before the launch.

The more accurate or heavy duty arm pitching machines are often heavy and bulky. These machines often allowed the ability to effectively vary the speed of the pitched ball as hurled from the pitching arm, but the throwing motion limited the ability to change the pitches on a horizontal axis. Furthermore, these machines typically required manual adjustment for the speed and or vertical trajectory by means of hand cranks.

An example of a ball-throwing machine that employs a spring mechanism to propel the ball as generally described is U.S. Pat. No. 3,757,759 which issued on Sep. 11, 1973 to J. G. Haworth for Automatically Varied Oscillation Type Ball Projecting Device. Perhaps the most common spring-actuated machine is the IRON MIKE pitching machine marketed by Master Pitching Machine, Inc. of Kansas City, Mo. The IRON MIKE machine comes in both a baseball and a softball version. See U.S. Pat. No. 4,524,749 which issued on Jun. 25, 1985 to Paul S. Giovagnoli for Spring-Type Ball Pitching Machine.

In a commercial environment, this spring-actuated arm pitching machine is typically installed in an individual batting cage, frequently with a ball retrieval system. It is mounted at one end of the cage with the hitter at the opposite end. As generally stated above, the advantage that a spring-actuated pitching machine has over conventional wheeled machines is that the movement of the spring-actuated arm gives the hitter some warning that a ball is about to be delivered and assists him or her with timing the pitch. Unfortunately, these machines tend to always throw the same horizontal trajectory due to the movement of the swing arm not being adjustable to vary the horizontal axis. This typically allows the player to be prepared to hit a predetermined path which is not typical of an actual game setting or a human pitcher in general. Currently, if a batter wishes to work on hitting pitches that are "inside" or "outside" the normal path, the player must move respectively closer to the path or farther from the predetermined path.

As the demand increases for better pitching machines that more closely simulate real pitching and batting, today's players are looking for new means to have more realistic batting practice. The prior art devices and methods have failed to bridge the gap between the user needs and the currently available alternatives. Therefore, an extensive opportunity for advancements and innovation remains where the prior art fails or is deficient.

SUMMARY OF THE INVENTION

In view of the foregoing disadvantages inherent in the known types of pitching machines now present in the prior art, the present invention provides a new and improved machine and or converter to existing machines that allows for more realistic pitching and therefore batting practice. As such, the general purpose of the present invention, which will be described subsequently in greater detail, is to provide a new and improved ball throwing machine and or adapter for existing machines which has all the advantages of the prior art and none of the disadvantages.

It is understood that the current invention may be utilized as adapter or converter for existing ball throwing machines of all configuration and not just limited to swing arm machines. It is also understood that the current invention may provide a new and improved ball pitching machine which may be utilized for other sports other than baseball, such as but not limited to softball, cricket, tennis, and so forth.

It is further to be understood that the current invention may provide a means to vary the vertical trajectory of a pitched ball, the horizontal trajectory of the pitched ball, the speed of the pitched ball, as well as the dynamics or sequence of the type of pitch as selectively desired.

To attain this, the present invention essentially comprises a frame that may be utilized on existing machines or incorporated into the design such as but not limited to the IRON MIKE. The frame may be placed beneath the pitching machine or incorporated into the machine, which allows the machine to pivot in the horizontal axis as desired to allow for the delivery of the pitched ball in varied horizontal trajectories as well as relatively random selection of the horizontal trajectory as desired.

Furthermore, the present invention may include an adapter to current machines or incorporated into new machines a means to relatively randomly change the speed and vertical axis of a pitched ball. It is contemplated to provide an automatic system to be incorporated into the speed and height adjustments which are currently manually cranked by two screw mechanisms in the prior art. It is contemplated to provide a hydraulic pump that provides variation to the height and speed manual adjustments.

It is still further contemplated to provide a computer control system for selecting the horizontal path, varying the horizontal path, selecting the vertical path, varying the vertical path, selecting the speed, varying the speed and combinations thereof. It is contemplated to have preset settings such as "pitch #1", "pitch #2", and so forth that can allow the machine to deliver fast pitches inside, slow pitches outside, and so forth.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved pitching machine adapter or converter that can be readily adapted to existing equipment used such as but not limited to the IRON MIKE pitching machine.

It is a further object of the present invention to provide a new and improved ball pitching machine, which may also be utilized specifically for baseball pitching, but may also be utilized for other sports where it is desired to throw a ball such as softball, tennis and so forth.

An even further object of the present invention is to provide a new and improved pitching machine, which may provide realistic baseball pitch scenarios of varied vertical and horizontal trajectories as well as speed.

Still another object of the present invention is to provide a new and improved pitching machine which provides all of the advantages of the prior art, while simultaneously overcoming some of the disadvantages normally associated therewith.

Another object of the present invention is to provide a new and improved pitching machine which is of a durable and reliable implementation.

A further object of the present invention is to provide a new and improved pitching machine which is susceptible to a low cost of operation. Accordingly, it is then susceptible to low prices of use or implementation, thereby making such economically available to the respective sports industry.

Still yet, another object of this invention is to provide a new and improved pitching machine that allows for a selectively random trajectory and speed of pitches as desired for batting practice.

It is even a further object of the present invention to provide a new and improved pitching machine that has a computer control for selecting types of pitches, sequence of pitches, speed, vertical path, horizontal path and so forth.

Yet another object of the present invention is to provide a new and improved pitching machine that has a remote control that may activate the machine and the settings of the pitches from near the batter or just generally away from the machine.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings, illustrations, pictures, and appendices.

DETAILED DESCRIPTION OF THE PREFERRED EMBODIMENTS

Figure 1:
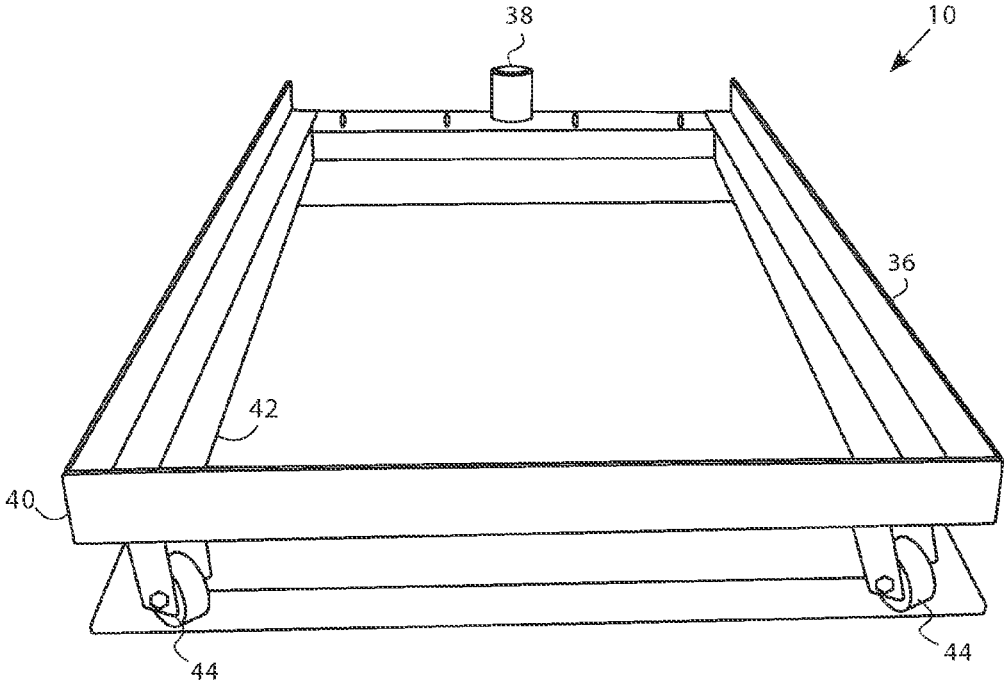
FIG. 1 generally depicts a preferred embodiment of the invention frame assembly.

Referring to the illustrations, drawings, and pictures, reference character 10 generally designates a new and improved pitching machine. Of note, it is understood that the invention 10 may be used in other applications other than specifically to baseball or softball pitching, thus, the title of the invention should not be considered to limit the scope of the invention. It is contemplated that the current invention may be utilized in any activity where it is desirable to throw a ball, sphere, and so forth. Furthermore, it is contemplated that the invention may be retrofitted to existing machines, made in conjunction with new machines, a stand alone machine and combinations thereof.

Invention 10 may be used in conjunction as a retro-fit, adapter, or converter to IRON MIKE pitching machines. Likewise, invention 10 may be utilized specifically with other pitching machines. It is understood that other equipment could be used not associated with the aforementioned. It is further contemplated that invention 10 may be utilized as a stand-alone unit.

The prior art IRON MIKE machine is generally depicted in FIGS. 6, 7, 8 and 9 and discussed in greater detail below. The machine is swing pitching arm design wherein arm 11 rotates to pitch a ball held in the end of arm 11. The end of arm 11 has a receptacle 13, also known in the art as the "hand" to hold the ball, which is rotationally thrown from the hand toward the hitter.

Figure 6:
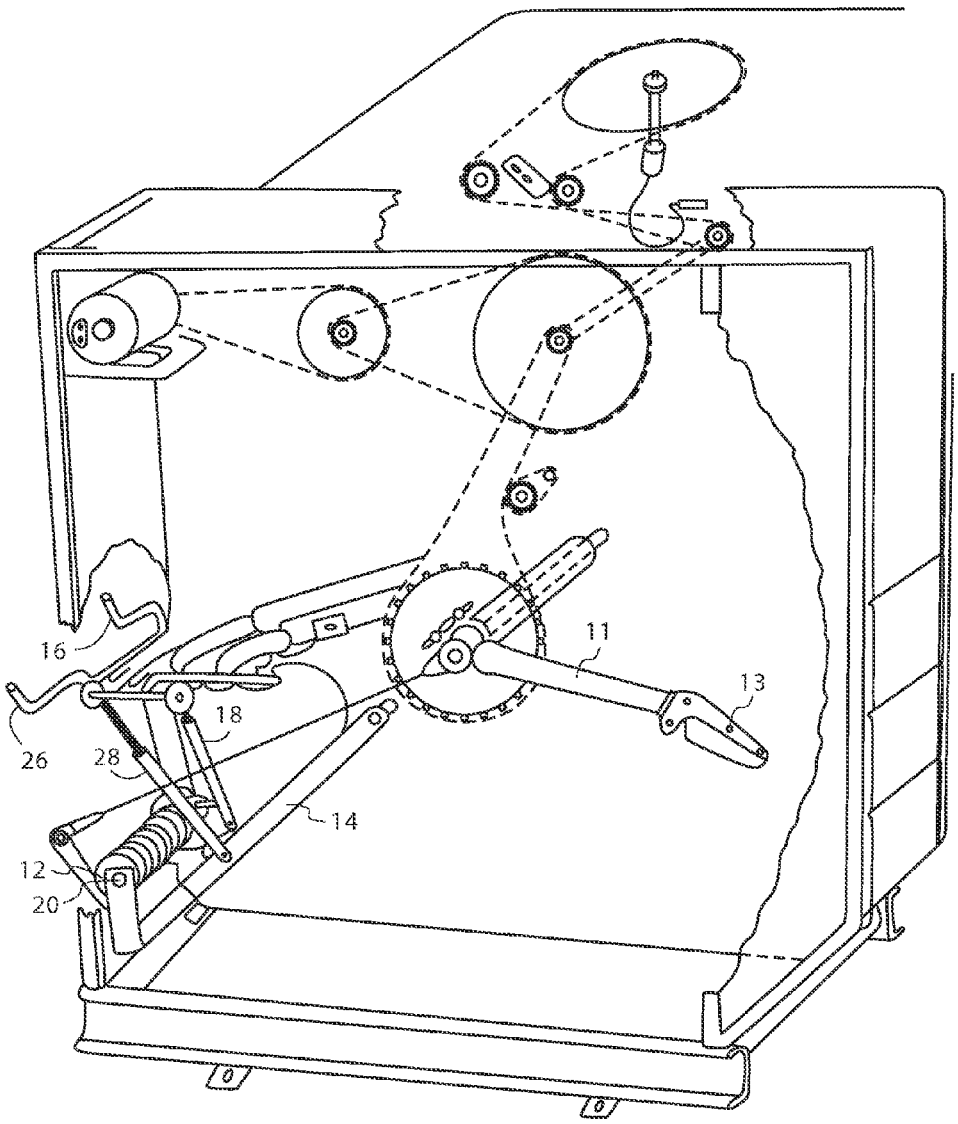
FIG. 6 (PRIOR ART)
FIG. 6 is a partially exploded view of a prior art device sold under the trademark IRON MIKE generally depicting the swing arm mechanism.
Figure 7:
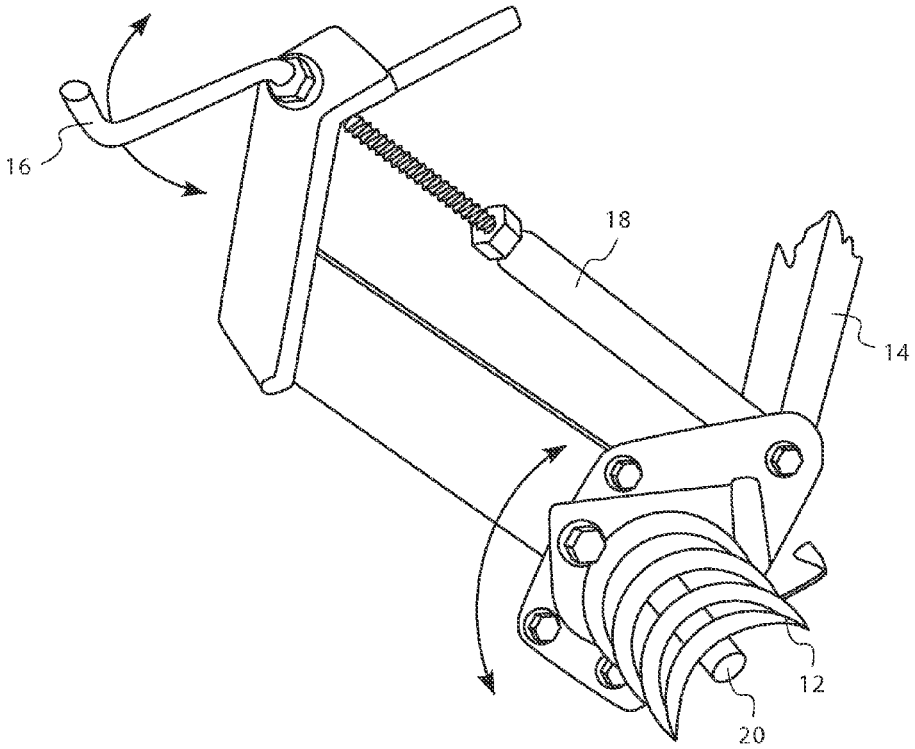
FIG. 7 (PRIOR ART)
FIG. 7 is a partial view of a prior art device sold under the trademark IRON MIKE generally depicting a pitch speed control mechanism.
Figure 8:
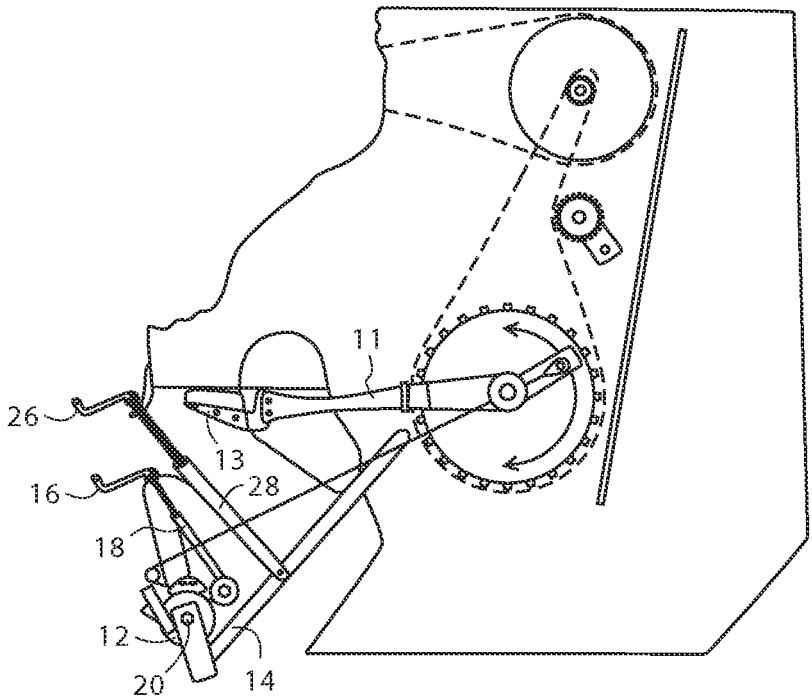
FIG. 8 (PRIOR ART)
FIG. 8 is a partial view of a prior art device sold under the trademark IRON MIKE generally depicting the swing arm mechanism boom setting that controls the height of the pitch wherein the setting is for a high pitch and the spring boom is conversely set to low position.
Figure 9:
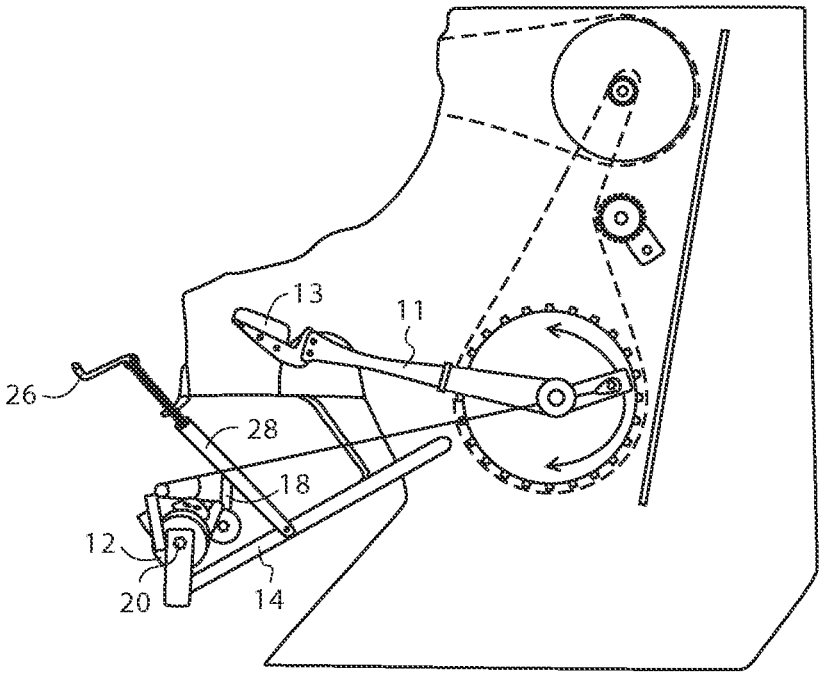
FIG. 9 (PRIOR ART)
FIG. 9 is a partial view of a prior art device sold under the trademark IRON MIKE generally depicting the swing arm mechanism boom setting that controls the height of the pitch wherein the setting is for a low pitch and the spring boom is conversely set to high position.

Prior art depiction FIG. 6 generally depicts an IRON MIKE machine. Prior art depiction FIG. 7 generally depicts a closer view of an IRON MIKE pitch speed control mechanism. Prior art depiction FIGS. 8 and 9 generally depicts the IRON MIKE boom setting that controls the height of the pitch. FIG. 8 generally shows the IRON MIKE set for a high pitch setting wherein the spring boom 14 is conversely set to low position. FIG. 9 generally shows the IRON MIKE set for a low pitch setting wherein the spring boom 14 is conversely set to a high position. Of note, there is no horizontal means to control the pitch on the IRON MIKE machine depicted.

Speed Control of Pitch

Figure 4:
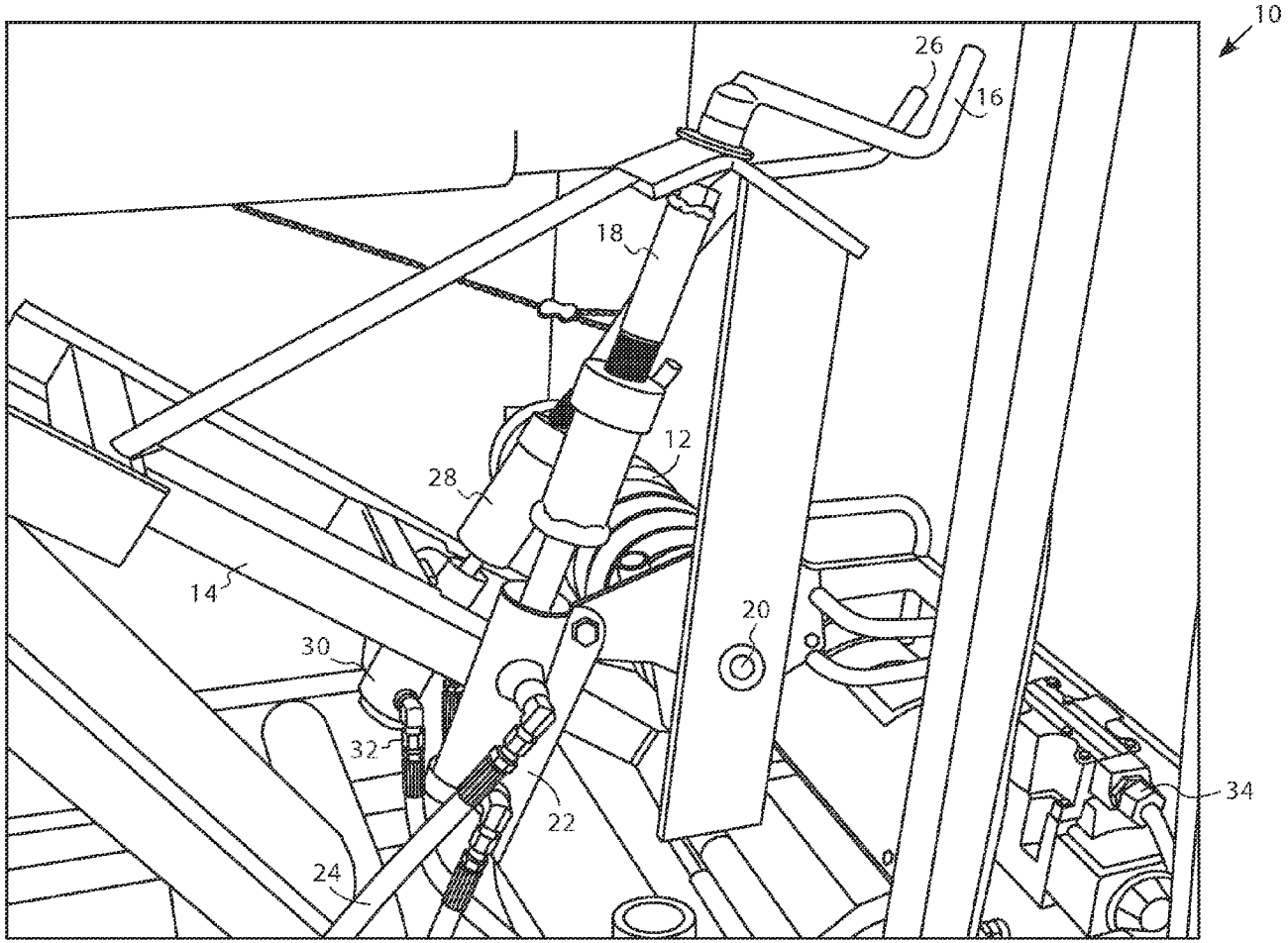
FIG. 4 generally depicts a preferred embodiment of the invention height and speed adjustment systems.
Figure 5:
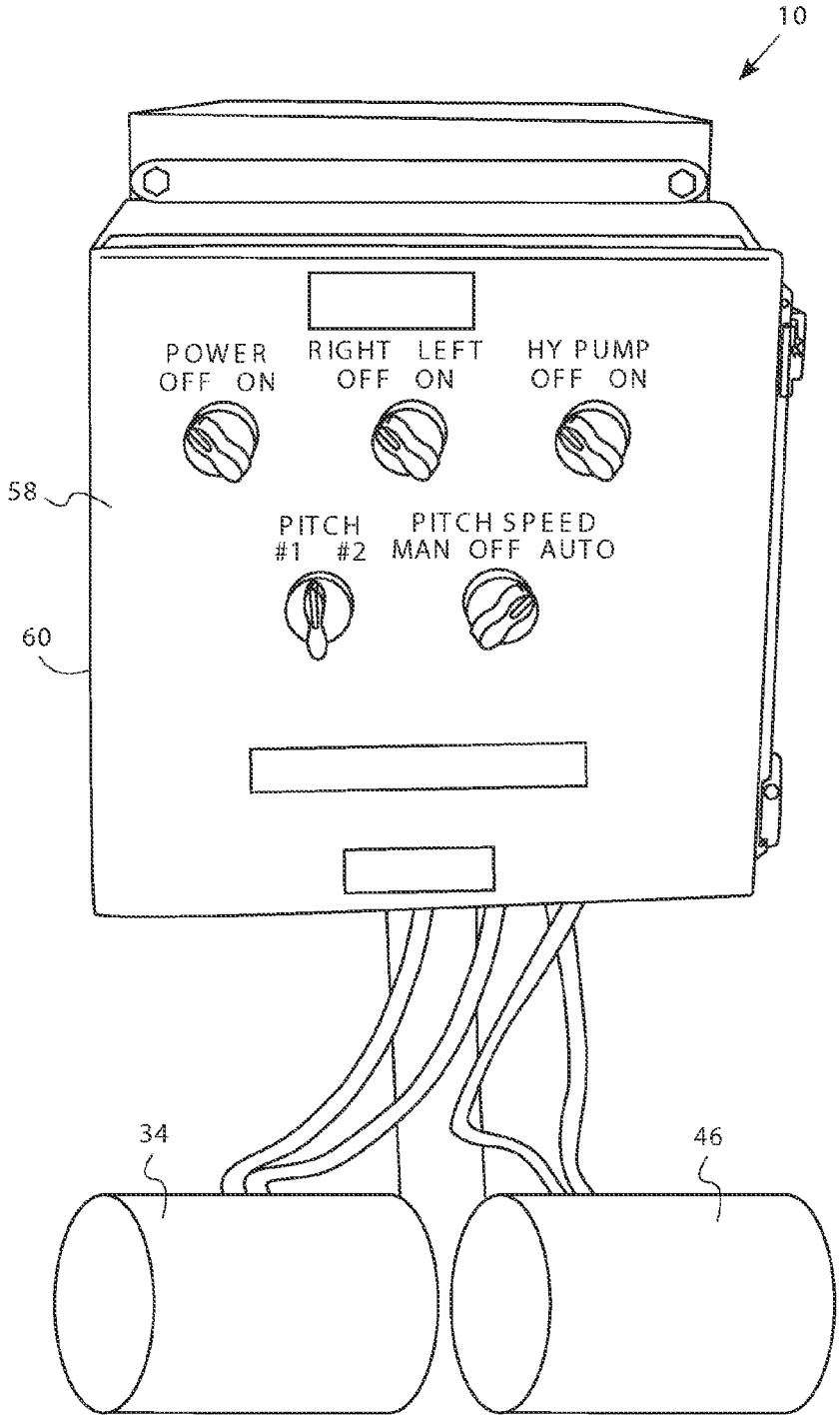
FIG. 5 generally depicts a preferred embodiment of the invention control system.

Now generally referring to the prior art depictions and FIG. 4, pitching machines such as the IRON MIKE, had an adjustment for controlling speed or strength of the pitch. Speed of the pitch generally depends on the tension of the torsion spring 12 generally attached to the spring boom 14 wherein increasing the speed of the pitch is accomplished by rotating the speed adjustment handle 16 clockwise thereby compressing torsion spring 12 as the speed adjusting rod 18 is shortened. The shortening of the speed adjustment rod 18 generally compresses the torsion spring 12 by rotating or winding the torsion spring 12 along axis 20.

Decreasing the speed of the pitch is generally accomplished in the opposite, wherein the speed adjustment handle 16 is rotated counterclockwise thereby increasing the length of the speed adjustment rod 18 and such that torsion spring 12 compression is decreased.

Referring now to FIG. 4 more in specific, in a preferred embodiment, speed adjustment rod 18 is generally supplemented with a hydraulic piston 22 wherein the length of the speed adjustment rod 18 may be shortened and lengthened automatically with pre-set increments. As generally discussed above, the lengthening and shortening of the speed adjustment rod 18 respectively decreasing or increases the compression of torsion spring 12 thereby throwing a slower or faster pitch. Piston 22 may be hydraulically activated. It is understood that other means may be utilized other than hydraulic piston 22 for the tensioning of torsion spring 12 via adjustment of speed adjustment rod 18, such as an electric motor attached to speed adjustment rod 18.

It is contemplated to provide a speed adjustment system 24 for selectively varying the speed of said ball on said trajectory that is generally selectively automatic and does not require the manual hand cranking of the speed adjustment handle 16. It is understood that speed adjustment system 24 may utilize a hydraulic system of hoses, motors, piston 22 and so forth that may be controlled with an electric motor.

Height Control of Pitch

In the prior art, pitching machines such as the IRON MIKE, had an adjustment for controlling the height of the pitch. It is understood that the object of pitching machines in general is to pitch a ball into a designated strike zone at a distance. It is also understood that increasing the pitch speed will increase the pitch elevation or height. It is understood that if the pitch is slower, the pitch trajectory will need to arch to get inside the strike zone and therefore, the angle of the pitch must be raised.

It is also generally understood the opposite is true wherein the faster the pitch, the less arch and a lower angle of trajectory. It is therefore understood that a pitching machine must have the trajectory or height of the pitch modified respectively with the speed of the pitch.

The height of the pitch is changed by varying the firing point of the arm 11. In general, a lower spring boom 14 results in a high pitch due to the early release of the pitching arm 11 as generally depicted in Prior Art depiction FIG. 8. With a raised spring boom 14, a lower pitch results due to the later release of the pitching arm 11.

Now generally referring to the prior art depictions and FIG. 4, pitching machines such as the IRON MIKE have an adjustment for controlling the height of the pitch. The pitch height generally depends on the position of the spring boom 14 starting point wherein the lower the start point of the spring boom 14 is positioned, the higher the pitch and vice versa where the higher the spring boom 14 position starts, the lower the pitch. The starting point of spring boom 14 is adjustable by the height adjustment handle 26 which lengthens or shortens height adjustment rod 28 thereby lowering or raising spring boom 14.

Referring now to FIG. 4 more in specific, in a preferred embodiment, height adjustment rod 28 is generally supplemented with a hydraulic piston 30 wherein the length of the height adjustment rod 28 may be shortened and lengthened automatically with pre-set increments. As generally discussed above, the lengthening and shortening of the height adjustment rod 28 respectively raises or lowers spring boom 14 thereby throwing a lower or higher pitch. Piston 30 may be hydraulically activated. It is understood that other means may be utilized other than hydraulic piston 30 for the raising and lowering of spring boom 14 via adjustment of height adjustment rod 28, such as an electric motor attached to height adjustment rod 28.

It is contemplated to provide a height adjustment system 32 for selectively varying the height of said ball on said trajectory that is generally selectively automatic and does not require the manual hand cranking of the height adjustment handle 26. It is understood that height adjustment system 32 may utilize a hydraulic system of hoses, motors, piston 30 and so forth that may be controlled with an electric motor.

It is also contemplated that speed adjustment system 24 and height adjustment system 32 may utilize a common power source 34. The respective system may be connected or stand alone and may be but is not limited to a hydraulic pump.

Horizontal Adjustment System Control

Figure 2:
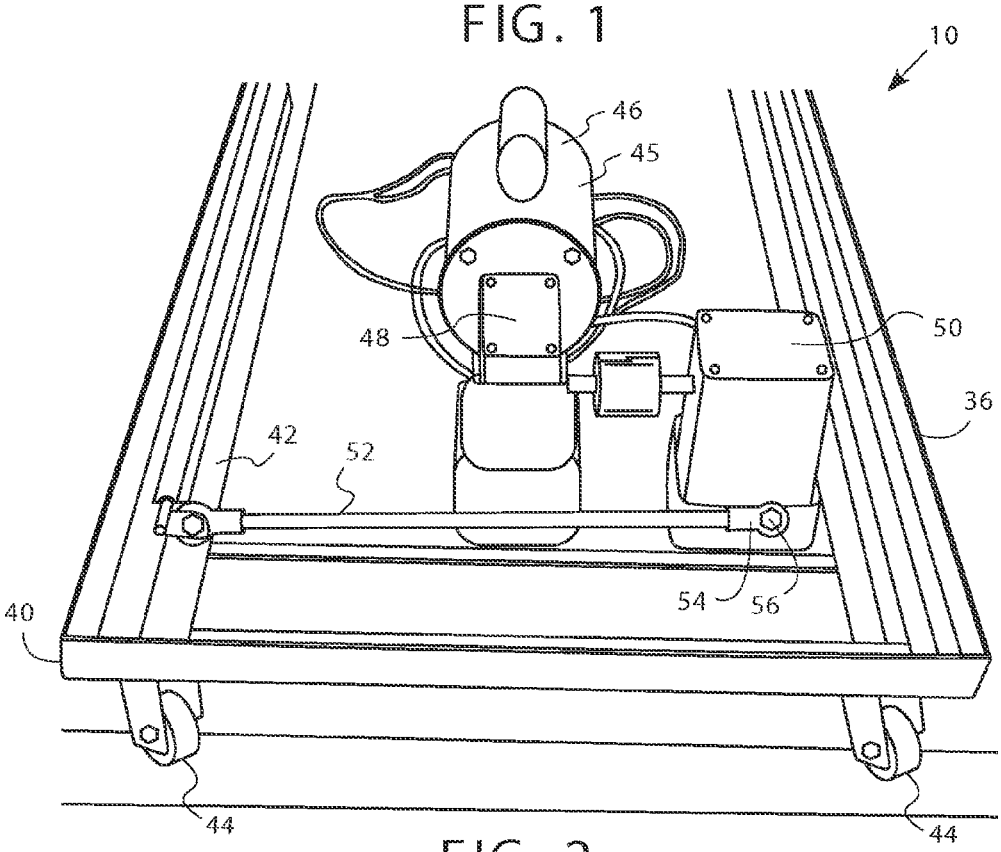
FIG. 2 generally depicts a preferred embodiment of the invention frame assembly.
Figure 3:
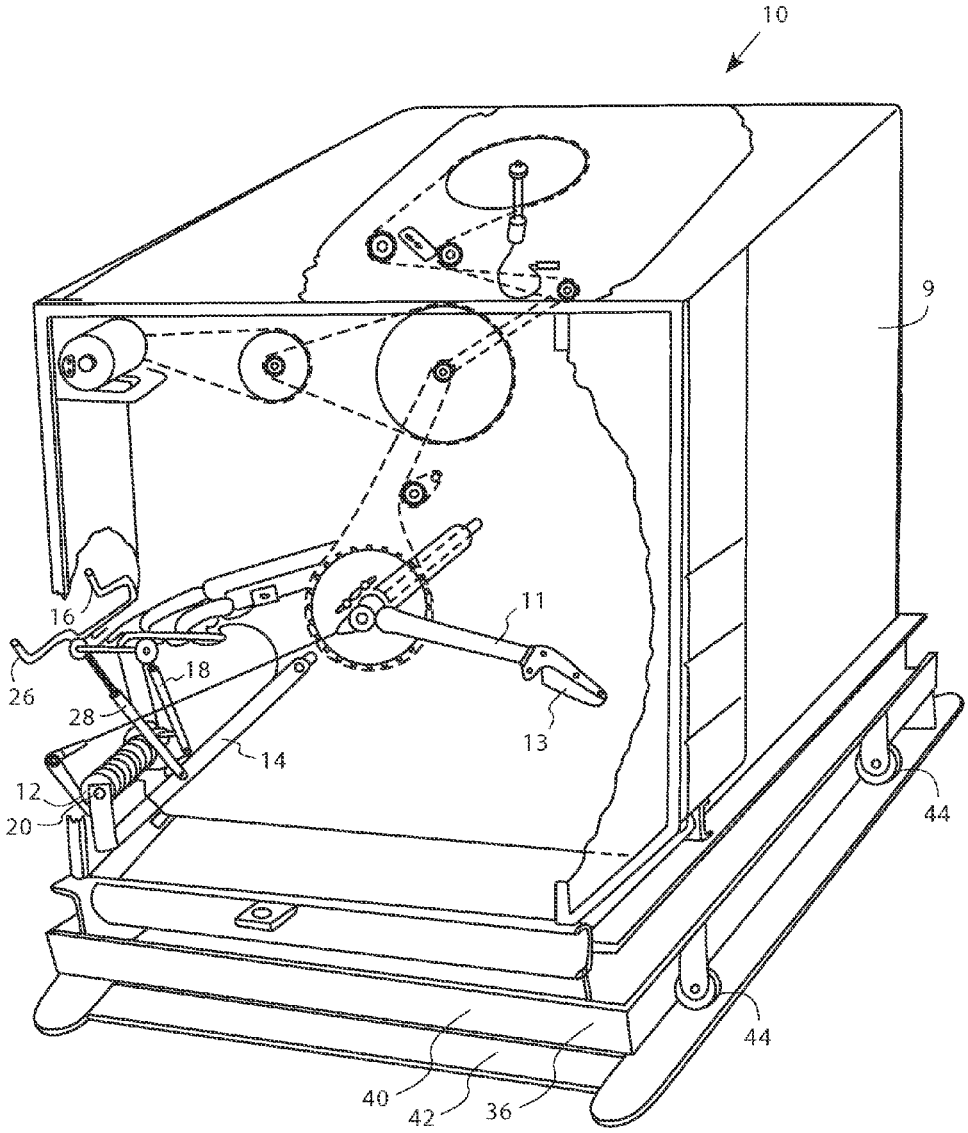
FIG. 3 generally depicts a preferred embodiment of the invention frame assembly with a swing arm pitching machine.

Once again referring to the drawings and more specifically FIGS. 1, 2, and 3, in a preferred construction, invention 10 may include frame assembly 36 for providing horizontal movement around pivot point 38 in a general arc fashion. It is contemplated to provide a pitching machine 9 that may be placed on frame assembly 36 such that the front of pitching machine 9 may be rolled in a horizontal fashion in either left or right directions as desired and around arc from pivot point 38. It is also contemplated that movement may be manual or through a lever arm. It is understood that invention 10 may be of a retro-fit to an IRON MIKE pitching machine or be of a new or different design of a swing arm pitching machine.

Frame assembly 36 may include pivot point 38, top frame 40, bottom frame 42, and wheels or rollers 44. It is understood there are various configurations of wheels and rollers 44 and the drawings are for illustrative purposes. It is also understood that the rollers 44 depicted are not necessarily aligned for depicting side to side motion. Still furthermore, it is understood that the rollers 44 may rotate or be fixed in place along the desired travel arc.

It is contemplated that bottom frame 42 may be attached to the ground in a removable or fixed fashion. It is also contemplated that top frame 40 may be removable attached or generally incorporate into a pitching machine 9. Top frame 40 may have rollers 44 under one end, which may be welded at an angle to allow top frame 40 to generally roll in an arc from the center pivot 38. It is contemplated that top frame 40 may have one channel iron side with three angle iron sides. The outer center pivot may be in the channel iron end. The channel iron may have grooves ground into the under-side. It is contemplated to provide grooves to distribute grease. The channel iron side may have four grease fittings in the top and two in the center pivot.

Bottom frame 42 may have a pipe for an inner center pivot and a frame on which the channel iron rides. This may be similar to a fifth-wheel hitch. Bottom frame 42 may also anchor to concrete.

It is contemplated that frame assembly 36 may include a motor assembly 45 for automatically moving top frame 40 respective to bottom frame 42 around pivot point 38 such that machine 9 moves in a horizontal fashion along an arc thereby providing a means to change the path of a pitched ball either in a right or left fashion as desired or in a relatively random sequence of right and left variations.

Motor assembly 45 may include an electric motor 46, gear box 48, a second gear box 50, tie rod 52, a coupling such as but not limited to a love joy coupling 54, an eccentric hub 56. Gear box 50 and second gear box 52 may have several different gear ratios. Motor 46 may be of various powers with a preferred embodiment being ½ horsepower electric motor.

Second gearbox 50 may also have different ratios, depending on what speed is desired wherein generally the faster it is the more unpredictable the path of the ball. The output shaft on the second gearbox 52 may have eccentric hub 56. Tie rod 52 may bolt on eccentric hub 56 such that when turned on, the top frame 40 may go back and forth on rollers 44.

Eccentric hub 56 generally provides the horizontal movement. To change the width of the strike zone or horizontal trajectory in general, it is contemplated to loosen the nut then turn the bolt to pull the bolt in closer to center; it may narrow the strike zone or generally restrict the horizontal motion. Furthermore, to push the bolt out away from center widens the strike zone or generally allows for more horizontal motion.

It is also contemplated to provide a machine that has an internal frame that may change the horizontal direction with the movement of the mechanism on a rotating platform. It is further contemplated that numerous devices may be utilized to vary the horizontal pitch degree.

Pitch Control System

It is contemplated to provide a selective pitch control system 58 wherein the speed of the pitch, the height of the pitch, and the horizontal positioning of the pitch may be selectively modified as desired, randomly selected, and combinations of random and selective changes in the height, speed, and horizontal trajectory. By example, it is contemplated that a computer program may be utilized and accessible through a control panel 60 which may be located on machine 9, by the batter for the batter to select, and or away from the machine and batter for another party to control without the batter knowing what settings have been made.

It is understood that a pitching machine is generally located at the same position as a human pitcher would be from the batter. It is also understood that an operator could operate the invention from the machine, near the batter such that the batter could operate the invention from the hitting position or away from both such that another could operate the machine from behind the batter, to the side of the batter and so forth.

Control panel 60 may contain a main power switch and or may be a master switch. When the right-left switch is turned ON the frame assembly 36 may go back and forth throwing a ball such as but not limited to a baseball back and forth across the plate or inside pitch or outside pitch or anywhere in between. User may turn it OFF while it is IN, OUT, or Down the MIDDLE and it will stay there meaning that it will throw the balls at the same spot over the plate until moved again.

The hydraulic pump and or power source 34 may change the speed control piston 22 and height control piston 30 with press to HOLD, or CHANGE positions. It may run at all times while the machine is running. The START and STOP turns the pitching machine ON and OFF. The red light may show power on the machine. The Pitch #1 button may be used in manual position for changing the pitch back to the off pitch or slower ball. Pitch #2 button may be used in the manual position for changing the pitch back to a fast pitch.

It is contemplated to provide a computer program or accessory that would allow a user to change the pitch speed, height, horizontal movement, and sequence of same. It is contemplated to provide preset or semi pre set sequences, such as 3FB-2SB-2FB-1SB-4FB-2SB-1FB (FB—Fast Ball) (SB—Slow Ball) and wherein the horizontal trajectory is randomly selected or semi-randomly selected.

It is also contemplated that selective pitch control system 58 may include a positioning sensor on speed piston 22 and height piston 30 wherein the control computer or control panel 60 would know what position the respective pistons were set. It is contemplated that linear switches may be located on the cylinders and or pistons thus allowing more numerous settings of speed and height.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

I claim:

1. A swing arm pitching machine for throwing a ball in a trajectory comprising:

a swing arm for throwing a ball in said trajectory;

a horizontal adjustment system in direct communication with said swing arm for selectively varying said trajectory of said ball horizontally wherein said horizontal adjustment system includes a frame with at least two wheels and a pivot for horizontally moving said pitching machine around said pivot, and an electric motor attached to said frame for pivotally moving said pitching machine horizontally as desired;

a height adjustment system in direct communication with said swing arm for selectively varying said trajectory of said ball vertically wherein said height adjustment system includes a first hydraulic piston having a sensor in communication with a hydraulic power source for operating said first hydraulic piston for adjusting said trajectory of said ball vertically as desired;

a speed adjustment system in direct communication with said swing arm for selectively varying the speed of said ball on said trajectory wherein said speed adjustment system includes a second hydraulic piston having a sensor in communication with said hydraulic power source for operating said second hydraulic piston for adjusting said speed of said ball on said trajectory as desired;

a control panel in communication with said horizontal adjustment system, said height adjustment system, said speed adjustment system via said sensors for automatically adjusting said trajectory as desired, said control panel is computer controlled, and said control panel is remote from said pitching machine and next to the batter.

* * * * *